US007079798B2

(12) United States Patent
Suzuki et al.

(10) Patent No.: US 7,079,798 B2
(45) Date of Patent: Jul. 18, 2006

(54) TONER TRANSFER BACK SUPPRESSING COLOR IMAGE FORMING APPARATUS

(75) Inventors: Kazumi Suzuki, Kanagawa-ken (JP); Ichiro Kadota, Tokyo (JP); Hisashi Shoji, Kanagawa-ken (JP); Atsushi Shinozaki, Chiba-ken (JP); Chikara Imai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/242,872

(22) Filed: Oct. 5, 2005

(65) Prior Publication Data

US 2006/0072943 A1 Apr. 6, 2006

(30) Foreign Application Priority Data

Oct. 5, 2004 (JP) ..... 2004-292243

(51) Int. Cl.
*G03G 15/01* (2006.01)

(52) U.S. Cl. ..... 399/302; 399/297; 399/298; 399/111; 399/259; 399/235; 399/359

(58) Field of Classification Search ..... 399/302, 399/297, 298, 111, 259, 235
See application file for complete search history.

(56) References Cited

U.S. PATENT DOCUMENTS

| | | | |
|---|---|---|---|
| 4,279,498 | A | 7/1981 | Eda et al. |
| 4,474,455 | A | 10/1984 | Hirakura et al. |
| 4,487,501 | A | 12/1984 | Suzuki et al. |
| 4,508,446 | A | 4/1985 | Imai |
| 4,522,481 | A | 6/1985 | Imai et al. |
| 4,632,537 | A | 12/1986 | Imai |
| 4,755,847 | A | 7/1988 | Matsushiro et al. |
| 4,910,557 | A | 3/1990 | Imai |
| 4,967,212 | A | 10/1990 | Manabe et al. |
| 4,975,748 | A | 12/1990 | Koinuma et al. |
| 5,003,354 | A | 3/1991 | Takamiya et al. |
| 5,051,760 | A | 9/1991 | Shoji et al. |
| 5,337,075 | A | 8/1994 | Takahashi et al. |
| 5,394,231 | A | 2/1995 | Sudo et al. |
| 5,508,520 | A | 4/1996 | Shoji et al. |
| 5,606,408 | A | 2/1997 | Yano et al. |

(Continued)

FOREIGN PATENT DOCUMENTS

JP 59-192159 12/1984

OTHER PUBLICATIONS

Patent Abstracts of Japan, JP 53-074037, Jul. 1, 1978.

(Continued)

*Primary Examiner*—David M. Gray
*Assistant Examiner*—G T E
(74) *Attorney, Agent, or Firm*—Oblon, Spivak, McClelland, Maier & Neustadt, P.C.

(57) ABSTRACT

A multi color image forming apparatus includes a plurality of stations arranged side by side for forming unique mono-color toner images using mono-color developers each having a different mono-color toner. Each of the plurality of stations includes an image bearing member for bearing a latent image, and a developing device for visualizing the latent image into the mono-color toner image. A conveying device is provided to convey a transfer medium. A transfer device is provided to transfer the mono-color toner images from the image bearing members to the transfer medium. Charge ability of prescribed mono-color toner included in the mono-color developer used in the upstream station is smaller than that used in the downstream station.

18 Claims, 8 Drawing Sheets

U.S. PATENT DOCUMENTS 5,619,316 A 4/1997 Shoji et al.
5,740,494 A 4/1998 Shoji et al.
5,864,733 A 1/1999 Mae et al.
5,915,155 A 6/1999 Shoji et al.
5,937,228 A 8/1999 Shoji et al.
5,970,280 A 10/1999 Suzuki et al.
5,999,762 A 12/1999 Shoji
6,160,979 A 12/2000 Shoji
6,389,260 B1 * 5/2002 Kataoka et al. ..... 399/298
6,456,806 B1 9/2002 Shoji et al.
6,505,014 B1 1/2003 Aoki et al.
6,597,884 B1 7/2003 Miyaguchi et al.
6,597,885 B1 7/2003 Kai et al.
6,658,227 B1 12/2003 Oyama et al.
6,671,484 B1 12/2003 Miyoshi et al.
6,708,015 B1 3/2004 Kurosu et al.
6,721,516 B1 4/2004 Aoki et al.
6,757,509 B1 6/2004 Shoji et al.
6,819,901 B1 11/2004 Yasutomi et al.
6,823,163 B1 11/2004 Sugimoto et al.
6,855,469 B1 * 2/2005 Ikeda et al. ..... 430/45
6,856,780 B1 2/2005 Kadota et al.
2002/0045114 A1 * 4/2002 Kaya et al. ..... 430/45
2003/0206754 A1 * 11/2003 Morita et al. ..... 399/299
2003/0207189 A1 * 11/2003 Shindoh et al. ..... 430/59.6
2004/0058260 A1 3/2004 Katoh et al.

OTHER PUBLICATIONS

Patent Abstracts of Japan, JP 2001-265087, Sep. 28, 2001.
Patent Abstracts of Japan, JP 2001-209232, Aug. 3, 2001.
Patent Abstracts of Japan, JP 09-106136, Apr. 22, 1997.
Patent Abstracts of Japan, JP 10-293432, Nov. 4, 1998.
Patent Abstracts of Japan, JP 2000-235291, Aug. 29, 2000.
Patent Abstracts of Japan, JP 2000-242152, Sep. 8, 2000.

* cited by examiner

FIG. 7

TABLE 1

| | AVERAGE CHARGE AMOUNT ($\mu$C/g) | ADHERING RATE OF EXTERNAL ADDITIONAL AGENT |
|---|---|---|
| CYAN TONER A | 18.92 | 78.3 |
| CYAN TONER B | 17.32 | 76.8 |
| MAGENTA TONER A | 16.42 | 76.5 |
| MAGENTA TONER B | 17.88 | 77.2 |
| YELLOW TONER A | 18.60 | 79.3 |
| BLACK TONER A | 17.57 | 72.3 |

FIG. 8

TABLE 2

| | | 1ST COLOR | 2ND COLOR | 3RD COLOR | 4TH COLOR |
|---|---|---|---|---|---|
| 1ST EXAMPLE | USAGE TONER | MAGENTA TONER A | YELLOW TONER A | CYAN TONER A | BLACK TONER A |
| | USAGE CARRIER | MAGNETIC CARRIER C | MAGNETIC CARRIER C | MAGNETIC CARRIER C | MAGNETIC CARRIER C |
| 2ND EXAMPLE | USAGE TONER | MAGENTA TONER A | YELLOW TONER A | CYAN TONER A | BLACK TONER A |
| | USAGE CARRIER | MAGNETIC CARRIER D | MAGNETIC CARRIER C | MAGNETIC CARRIER B | MAGNETIC CARRIER A |
| 3RD EXAMPLE | USAGE TONER | CYAN TONER B | YELLOW TONER A | MAGENTA TONER B | BLACK TONER A |
| | USAGE CARRIER | MAGNETIC CARRIER D | MAGNETIC CARRIER C | MAGNETIC CARRIER B | MAGNETIC CARRIER A |
| 1ST COMPARATIVE EXAMPLE | USAGE TONER | CYAN TONER A | YELLOW TONER A | MAGENTA TONER A | BLACK TONER A |
| | USAGE CARRIER | MAGNETIC CARRIER C | MAGNETIC CARRIER C | MAGNETIC CARRIER C | MAGNETIC CARRIER C |
| 2ND COMPARATIVE EXAMPLE | USAGE TONER | CYAN TONER A | YELLOW TONER A | MAGENTA TONER A | BLACK TONER A |
| | USAGE CARRIER | MAGNETIC CARRIER B | MAGNETIC CARRIER C | MAGNETIC CARRIER D | MAGNETIC CARRIER A |

FIG. 9

TABLE 3

| | RESULT OF DETERMINATION FOR 2ND COLOR | RESULT OF DETERMINATION FOR 3RD COLOR | TONER SCATTER EVALUATION AFTER EVALUATION |
|---|---|---|---|
| 1ST EXAMPLE | ○ | △ | SCATTER PRESENT |
| 2ND EXAMPLE | ○ | ○ | PROMINENT SCATTER UNIDENTIFIED |
| 3RD EXAMPLE | ○ | ○ | PROMINENT SCATTER UNIDENTIFIED |
| 1ST COMPARATIVE EXAMPLE | × | × | SCATTER PRESENT |
| 2ND COMPARATIVE EXAMPLE | × | × | PROMINENT SCATTER UNIDENTIFIED |

TONER TRANSFER BACK SUPPRESSING COLOR IMAGE FORMING APPARATUS

CROSS REFERRENCE TO RELATED APPLICATION

This application claims priority under 35 U.S.C. §119 to Japanese Patent Application No. 2004-292243 filed on Oct. 5, 2004, the entire contents of which are hereby incorporated herein by reference.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates to an image forming apparatus, such as a copier, a printer, a facsimile, etc., and a multi-functional machine including these apparatuses. In particular, this invention relates to a color image forming apparatus including a plurality of stations arranged side by side for forming and transferring different component color toner images from a plurality of image bearing members to a transfer medium in turn, either directly or indirectly via an intermediate transfer member.

2. Description of the Background Art

Recent office instruments have become required to handle a large number of color documents. As a result, a compact and high-speed color image forming apparatus, such as a full-color printer, a full-color copier, etc., is being demanded. In a recently commonly used color laser printer, a one-drum type is becoming main stream. Specifically, in such a device a plurality of developing devices are commonly used and accessibly arranged in the vicinity of an image-bearing member, so that respective color toner images are formed per its rotation and transferred from the image-bearing member to the transfer medium to form a full color toner image thereon.

The one drum type image forming apparatus is classified into two categories. One of them is an intermediate transfer system, in which a plurality of color toner images are formed on an image bearing member and primarily transferred and superimposed onto an intermediate transfer member. The superimposed color toner images are then secondarily transferred onto a transfer medium. The other type is a direct transfer system, in which a transfer medium is carried and conveyed by a transfer drum and a conveyance belt or the like. A plurality of color toner images are formed on image bearing members and are transferred onto a transfer medium in turn, and thereby a full color toner image is formed thereon.

A tandem (or an inline) type image forming apparatus has been proposed to realize speeding up of a color image formation. Specifically, three or four image bearing members are arranged side by side, and accordingly, a plurality of stations are arranged. A plurality of latent images are formed on the image bearing members at the respective stations and are developed by respective developing apparatuses. Then, the toner images are transferred in turn and superimposed on a transfer medium, and thereby a full color image is formed. For example, JOP53-74037 proposes an image forming apparatus with a plurality of image bearing members capable of transferring in turn and superimposing toner images on a transfer medium, which is conveyed by a belt type conveyance device.

Such a tandem type image forming apparatus allows faster image formation than that of the above-mentioned one drum type image forming apparatus by four times if peripheral speeds of their image bearing members are the same.

JOP59-192159 proposes an image forming apparatus that employs a tandem system with an intermediate transfer member.

Further, JOP2000-242152 proposes an image forming apparatus employing a collecting device that collects toner, which is transferred from the upstream image bearing member to the intermediate transfer belt, and which can be possibly transferred back to a downstream image bearing member due to its own reverse polarity. That is, a part of toner carries a polarity opposite to a normal polarity when transferred from the upstream image-bearing member to the intermediate transfer member and can be transferred back to the image-bearing member when downstream side color toner is transferred.

JOP10-293432 discusses a method of removing background potential before transferring a toner image to prevent toner from being oppositely charged, i.e., from transferring back.

JOP09-106136 proposes a multicolor image forming apparatus that uses magnetic toner of one and two component developer in first and second developing processes, respectively. A magnet is arranged inside of a photoconductive belt serving as an image-bearing member while being opposed to a developing sleeve arranged in a second developing device to increase an adhering force of the one component magnetic toner to the photo-conductive belt.

JOP2000-235291 discusses a technology in which a prescribed amount of charge is applied to toner of a toner image of a first color. JOP2001-209232 discusses a technology in which either a transfer process or a developing process is controlled to suppress an electrostatic attracting force applied to a latent image-bearing member that carries toner of reverse polarity. JOP2001-265087 discusses a technology in which a toner ratio of later used developer is more increased than that of previously used developer. Further, JOP2001-34045 proposes a method of decreasing a toner ratio of later used developer more than that of previously used developer while adjusting a direct current component of a developing bias.

SUMMARY OF THE INVENTION

Accordingly, an object of the present invention is to address and resolve such and other problems and provides a novel multi-color image forming apparatus. Such a novel multi-color image forming apparatus includes a plurality of stations arranged side by side for forming component color toner images using different mono-color developers. Each of the plurality of stations includes an image bearing member for bearing a latent image and a developing device for visualizing the latent image into a mono-color toner image. A conveying device is provided to convey a transfer medium. A transfer device is also provided to transfer the mono-color toner images from the plurality of image bearing members to the transfer medium. Charge ability of toner included in the mono color developer used in the upstream station is smaller than that of toner used in the downstream station.

In another embodiment, charge-applying ability of the upstream station is larger than that of the downstream station.

In yet another embodiment, a direct current developing bias is applied when each of the stations visualizes the latent image.

In yet another embodiment, adherence other than electrostatic adherence of toner to the image-bearing member is less than that to the transfer medium.

In yet another embodiment, the toner includes an external additive and toner mother body particle.

In yet another embodiment, the external additive includes at least two different inorganic fine particles.

In yet another embodiment, the external additive has a toner adhering rate not less than 70%.

In yet another embodiment, a collecting device is provided in each of the stations to collect the toner remaining on the image bearing member after transfer of the toner image onto the transfer medium. The collecting device conveys the toner to the developing device.

In yet another embodiment, the station further includes a charging device for charging the image bearing member, and a cleaning device for removing the toner remaining on the image bearing member after the transfer of the toner image. One of the charging device, the developing device, and the cleaning device is integrated with the image bearing member as a process cartridge to be detached from the multi-color image forming apparatus.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 7–9 are Tables 1–3 showing results and properties of implementations in the present invention, and comparative examples.

DETAILED DESCRIPTION OF THE PREFERRED EMBODIMENTS

Figure 1:
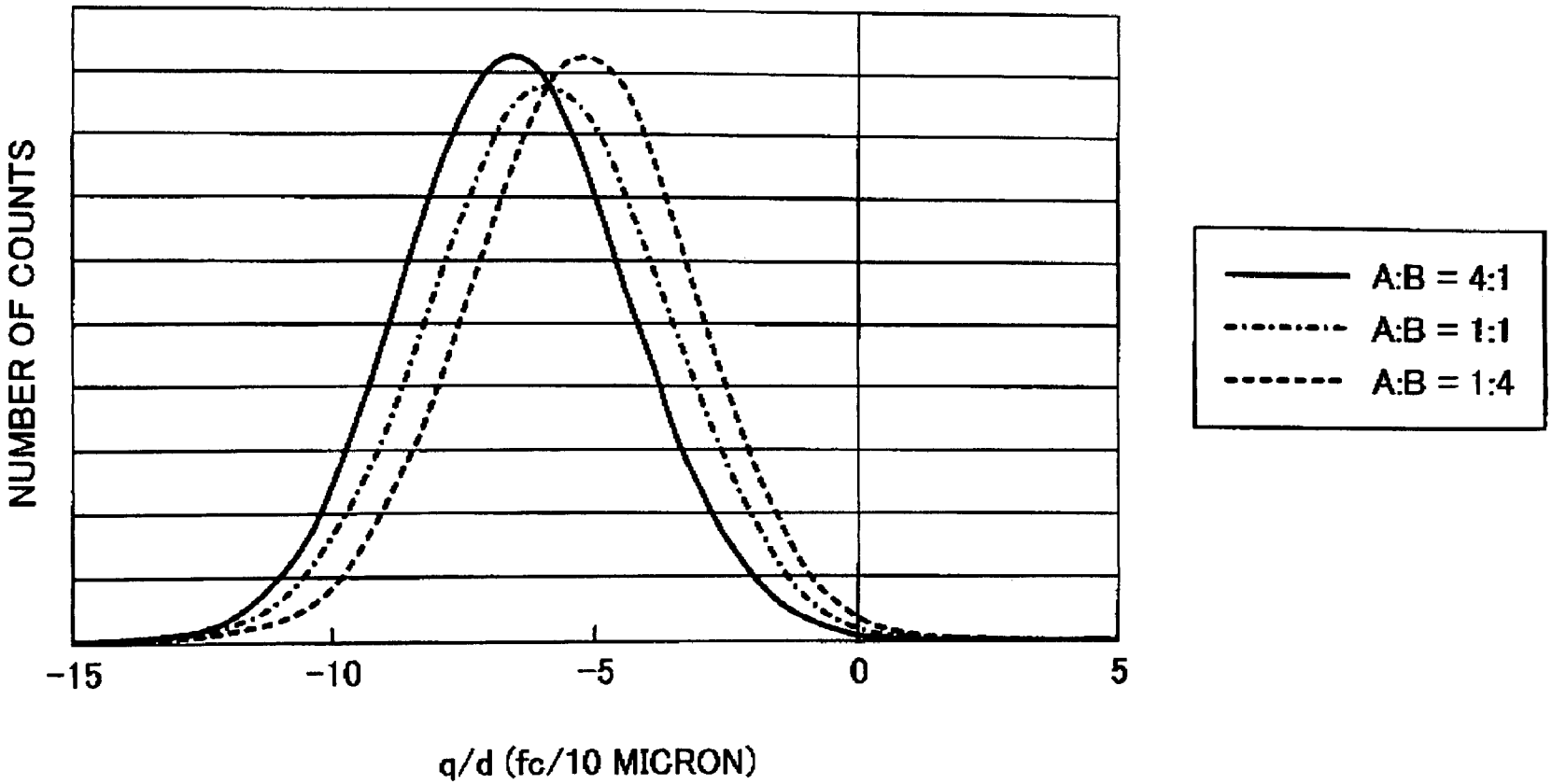
FIG. 1 illustrates exemplary charge amount distribution of three types of developer including toner samples prepared by mixing two different toners A and B by different weight ratio.

Referring now to the drawing, wherein like reference numerals designate identical or corresponding parts throughout several views, and in particular to FIG. 4, discussed in further detail below, a plurality of stations are arranged in a multi-color image forming apparatus side by side. Each of the stations includes an image bearing member and a developing device to form a unique mono-color toner image on the image bearing member using mono-color dry-type developer stored in the developing device. A conveying device is provided to convey a transfer medium. A transfer device is also provided to transfer each of the mono-color toner images in turn from the image-bearing members onto the transfer medium conveyed by the conveying device. Charge ability of toner in the dry type developer stored in an upstream station is less than that of a downstream station.

Thus, toner attracted to the image bearing member from the transfer medium is suppressed to enter and remain in the developing device of the downstream station.

The above-mentioned charge ability represents the ability of toner to acquire electric charge, and a level thereof is determined by the below-described manner.

Two types of toners A and B are mixed by different weight ratios of 4 versus 1, 1 versus 1, and 1 versus 4. Each of the toner samples thus obtained is mixed with reference carrier by a weight ratio of 100 versus 5, and a roll mill stirs the mixture for 5 minutes. Charge amount distributions of the thus prepared three developers are measured by the E-SPURT analyzer (manufacture by Hosokawa Micron Corp.) and compared with each other. As shown in FIG. 1, it is noted that waveforms of the charge amount distributions of the respective developers vary depending upon the mixture ratio. Specifically, comparing with the sample obtained by mixing the toners A and B by the ratio of 1 versus 1, the peak of the charge amount distribution shifts to a higher side when the toner having high charge ability has a small weight ratio. Whereas, the peak of the charge amount distribution shifts to the lower side when the toner having high charge ability has a large weight ratio. Accordingly, it is noted that charge ability of the toner A is larger than that of the toner B in this example.

When an alien color toner having smaller charge ability is unfortunately mixed into a developing apparatus, the alien toner is consumed by priority, thereby hardly remaining therein. Even when a mixed toner is consumed, the color tone of the resultant color image hardly changes if the mixture ratio of the alien color toner is sufficiently small. In contrast, when having larger charge ability, the alien toner is hardly consumed, and thereby the alien toner largely remains therein. As a result, the color tone significantly changes.

The method of controlling chargeability of toner is not restricted, but a method of changing one of the type of charge control agent used, the additional amount of charge control agent, and the type of an external toner additive is preferably used. Also, a usable method is to change a mixture ratio when more than two types of external toner additives are used. Further, chargeability can also be controlled by appropriately selecting a binder resin or a pigment.

According to one embodiment of the present invention, charge-applying ability of the upstream station is preferably controlled to be larger than that of the downstream station. As a charge-applying member, carrier (when two-component developer is used), or a developing roller and/or a doctor blade or the like (when one component developer is used), is exemplified. The charge applying ability of the charge-applying member is defined as an average toner charge amount of a reference toner obtained when the reference toner is charged under a prescribed condition. The larger the average toner charge amount, the higher the charge applying ability of the charge applying material. Although the charge applying ability is controlled by mainly selecting a type of the material, a mixture ratio of the material, and processing conditions of the charge-applying member, the controlling method is not limited to those.

When a latent image is to be visualized on the image-bearing member by adhering toner thereto with the developing apparatus, a direct current developing bias is preferably applied in each of the stations. Further, an attracting force other than an electrostatic attracting force of toner to the image bearing member is preferably controlled to be less than that to the transfer medium.

To decrease the non-electrostatic attracting force between the image bearing member and the toner, the image bearing member can be coated with lubricant, such as zinc stearate, etc.

The toner preferably includes an external additive and mother toner particles. The external additive preferably includes two or more different types of inorganic fine particles. A rate of an external additive adhering to toner (hereinafter referred to as a toner adhering rate) is preferably not less than 70%.

As an external additive, known materials can be employed, and for example oxide of metals such as Si, Ti, Al, Mg, Ca, Sr, Ba, In, Ga, Ni, Mn, W, Fe, Co, Zn, Cr, Mo, Cu, Ag, V, Zr, etc., and composite oxides thereof are exemplified. Especially, silica and titania (i.e., oxides of Si and Ti) are used because they have a good combination of fluidity, charge stability, and a recycling performance.

An amount of an external additive preferably ranges from 0.5 to 1.8, more preferably, 0.8 to 1.5 parts by weight in relation to 100 parts by weight of the mother particle. When an additional amount of the external additive is less than 0.6 parts by weight, fluidity and a charge performance of the toner tend to deteriorate. Further, the external additive may not sufficiently cover a pigment having a low charge performance, which is present on the surface of the toner particle. As a result, a background of images may be stained, toner scatters, and filming of the toner to the image-bearing member and spent carrier (contamination of carrier by toner in a case of two-component developer) may occur. In addition, transfer quality becomes uneven, white spots appears, and a thin line portion drops during image transfer. In contrast, when an additional amount of the external additive is not less than 2.0 parts by weight, vibration, image bearing member cleaning malfunction due to peeling off of a blade, and filming of the external additive separated from toner to the image bearing member tend to occur despite the improvement in fluidity. Thereby, durability of the cleaning blade and image-bearing member deteriorates. Further, influence of the mother particle on toner aggregation and non-electrostatic attracting force also decreases, and thereby the toner mixing prevention effect of the present invention can easily be produced.

The external additive preferably has a toner adhering rate not less than 70%, more preferably not less than 80%. That is, when the toner adhering rate is less than 70%, both of filming of the external additive separated from toner to the image bearing member and attraction to carrier tend to occur, thereby decreasing the durability of the cleaning blade, the image bearing member, and the carrier, or the like.

The toner adhering rate of the external additive is measured in the below-described manner. A part of toner mixed with an external additive is conveyed through a cyclone having a pneumatic separator in which airflow (i.e., a differential pressure of an air classification (i.e., a cyclone)) is set to be about 400 to 600 mmHg. Then, the external additive separated from the developer is removed from the upper portion of the cyclone while that adhering to the surface of the developer particle is collected from the lower portion of the cyclone together with the developer. By measuring and calculating the ratio between the weight of the developer before passing through the cyclone and that collected from the cyclone after passing therethrough, the toner adhering rate of the external additive is obtained.

Toner adhering rate of an external additive=Additional amount of a toner external additive after pneumatic separation/Additional amount of a toner external additive before pneumatic separation. Among various methods of measuring an additional amount of an external additive, a fluorescence X-ray analyzing method is commonly used. Specifically, an analytical curve of toner is obtained by the fluorescence X-ray analyzing method using toners with a known additional amount of an external additive, and an additional amount of an external additive is determined based on the analytical curve.

Further, an average primary diameter of a particle of an external additive is preferably from about 0.002 to about 0.2 μm, more preferably 0.005 to 0.05 μm in view of fluidity. When the average primary diameter is less than 0.002 μm, the fluidity is insufficient, because the external additive is easily embedded into the surface of the mother particle. Such tendency significantly appears when such an external additive is used for color toner having a sharp melting performance. Further, filming easily occurs on the image-bearing member (e.g. a photoconductive member) and such a tendency becomes significant when temperature and humidity are high. In addition, when the average primary diameter is less than 0.002 μm, aggregation unavoidably occurs among the external additives. As a result, fluidity becomes insufficient. In contrast, when the average primary diameter is not less than 0.2 μm, fluidity decreases, and accordingly, a charge performance is insufficient, thereby causing background fouling and toner scattering. Further, the surface of the image bearing member is easily damaged and causes filming or the like. A transmission type electronic microscope preferably measures the particle diameter of such an external additive.

The external additive preferably receives surface processing for the purpose of making hydrophobicity, improving fluidity, and controlling a charge performance. As a processing agent, organic silane compounds, for example, alkyl-chloro-silanes, such as methyl-trichloro-silane, octyl-trichloro-silane, dimethyl-dichloro-silane, etc.; alkyl-methoxy-silanes, such as dimethyl-dimethoxy-silane, and octyl-trimethoxy silane; hexa-metyhl-disilazane, silicone oils, etc., are preferably used. Further, as a processing manner, an external additive is immersed into solution including the organic silane compound and is dried, or solution including the organic silane compound is sprayed to an external additive and is dried, for example.

According to one embodiment of the present invention, a color image forming apparatus preferably includes an image bearing member and a developing device in each of the plurality of stations as mentioned above to form mono color toner images on the image bearing member using mono-color dry type developer stored in the developing device as mentioned earlier. Further included is a collecting device to collect and convey the toner remaining on the image bearing member to the developing device after transfer of the toner image onto the transfer medium.

The color image forming apparatus further includes a charging device that charges the image-bearing member, and a cleaning device that removes the toner remaining on the image-bearing member after the transfer of the toner image. Further, one of the charging device, the developing device, and the cleaning device is integrated with the image-bearing member as a process cartridge to be detached from the multi color image forming apparatus.

Figure 2:
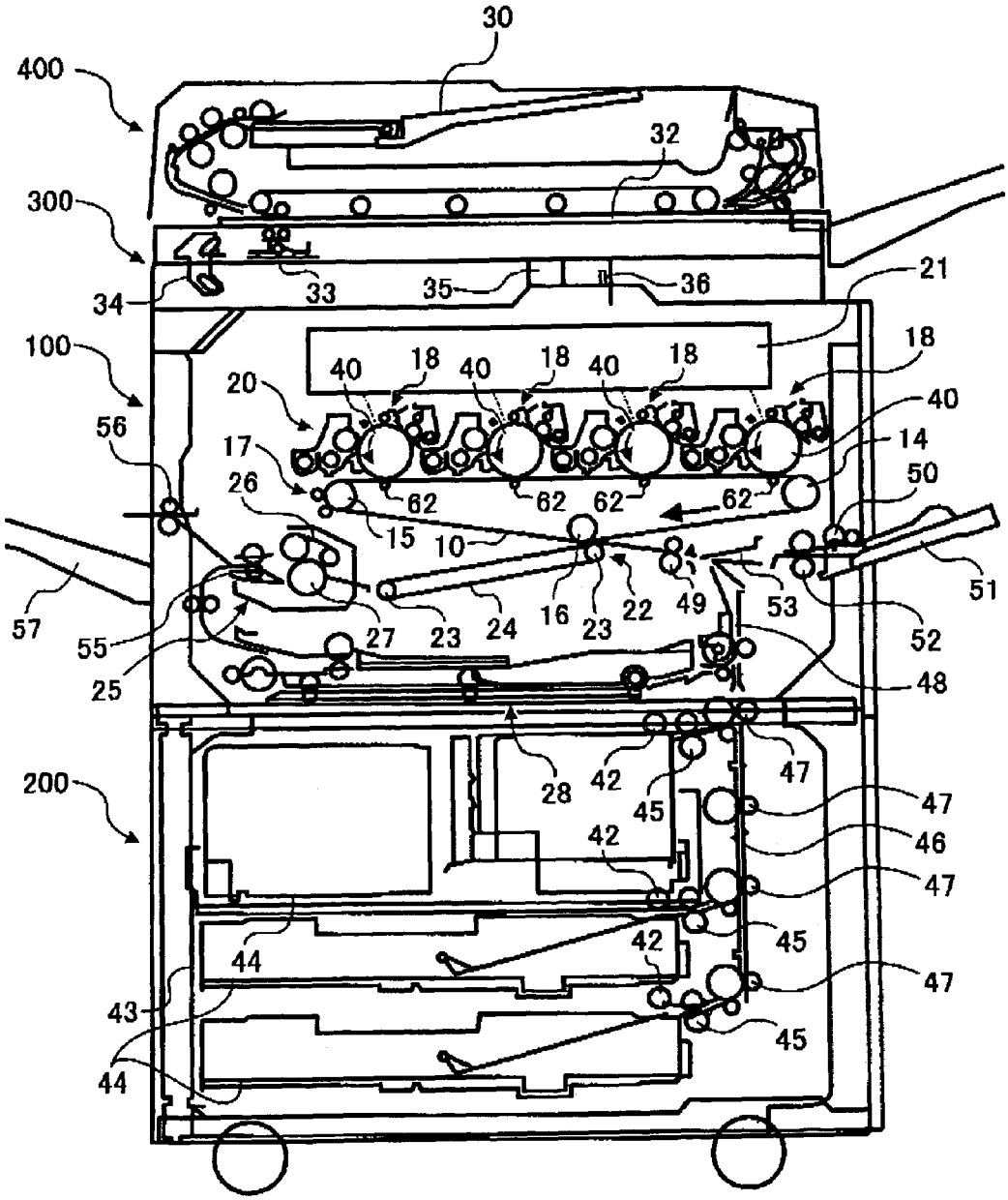
FIG. 2 illustrates an exemplary tandem indirect transfer type color copier according to one embodiment of the present invention.

Specifically, as shown in FIG. 2, a copier body 100 is provided. A sheet-feeding table 200 is provided to support the copier body 100. A scanner 300 is attached to the upper portion of the copier body 100. An automatic document feeder (ADF) 400 is attached above the scanner 300.

An intermediate transfer member 10 of an endless belt type is arranged in the middle of the copier body 100, and is wound and rotated in a clockwise direction by three supporting rollers 14, 15, and 16.

An intermediate transfer member cleaning apparatus 17 is arranged on the left side of the second supporting roller 15 to remove toner remaining on the intermediate transfer member 10 after toner image transfer.

Four stations for black, cyan, magenta, and yellow colors are arranged above and along with the intermediate transfer member 10. An image formation unit 18 is laterally arranged in each of the respective stations to form a tandem image formation apparatus 20.

As shown in FIG. 2, an exposure apparatus 21 is arranged above the tandem type image formation apparatus 20.

On the opposite side of the intermediate transfer member 10 to the tandem type image formation apparatus 20, a secondary transfer apparatus 22 is arranged. The secondary transfer apparatus 22 is formed by winding a second endless transfer belt 24 wound around a pair of rollers 23, for example. An image on the intermediate transfer member 10 is transferred onto a transfer medium while the secondary transfer apparatus 22 pressure contacts the third supporting roller 16 via the intermediate transfer member 10.

Beside the second transfer apparatus 22, a fixing apparatus 25 is arranged to fix a transferred image onto the transfer medium. The fixing apparatus 25 includes an endless fixing belt 26 and a pressure-applying roller 27 pressure contacting the fixing belt 26, for example. Thus, the second transfer apparatus 22 functions to convey the transfer medium to the fixing apparatus 25 after image transfer.

A non-contact type charger can be employed as a second transfer apparatus 22 together with a transfer medium conveyance device.

A transfer medium inversion apparatus 28 is arranged below the second transfer apparatus 22 and the fixing apparatus 25 in parallel to the above-mentioned tandem image formation apparatus 20 so as to invert the transfer medium to record images on both sides thereof, for example.

When a copy is to be made using the color copier, an original document is set to an original document table 30 of the ADF 400. Otherwise, an original document is directly set to a contact glass 32 of the scanner 300 by opening and closing the ADF 400.

When a start switch (not shown) is depressed, first and second carriage members 33 and 34 start moving either after the original document is conveyed onto the contact glass 32 when the original document is set on the ADF 400 or after the scanner is immediately driven. The original document is read by the following procedure. First, light is emitted from a light source of the first carriage 33. The light reflected from the surface of the original document is further reflected toward the second carriage 34. A mirror of the second carriage 34 further reflects the light. The light is transmitted through an imaging lens 35, and enters into the reading sensor 36.

Further, when the start switch is depressed, one of the supporting rollers 14, 15, and 16 is rotated by a driving motor (not shown), and thus drives the other supporting rollers, thereby rotating the intermediate transfer member 10.

Simultaneously, an image bearing member 40 of each of the image formation units 18 is rotated to form each of black, yellow, magenta, and cyan mono-color images thereon. Then, as the intermediate transfer member 10 is conveyed, respective mono-color images are transferred onto the intermediate transfer member 10 in turn in this order from the most upstream station to be superimposed.

Further, when the start switch is depressed, one of sheet feeding rollers 42 of the sheet-feeding table 200 is selectively rotated, and transfer mediums are launched from one of multistage sheet feeding cassettes 44 included in a paper bank 43. A separation roller 45 separates and feeds the transfer mediums one by one into a sheet conveyance path 46. A conveyance roller 47 conveys the sheet to a sheet conveyance path 48 in the copier body 100, so that the transfer medium collides and is stopped at a registration roller 49.

Further, transfer mediums laying on a manual sheet feeding tray 51 are launched by rotating a sheet feeding roller 50, and are separated and launched into a manual sheet feeding path 53 one by one by a separation roller 52. The transfer medium collides and is stopped at a registration roller 49.

The registration roller 49 is rotated to convey the transfer medium between the intermediate transfer member 10 and the secondary transfer apparatus 22 in synchronism with a toner image on the intermediate transfer member 10. Thus, a color image is transferred onto the transfer medium by the secondary transfer apparatus 22.

The transfer medium is further conveyed after receiving image transfer to the fixing apparatus 25 by the second transfer apparatus 22. The toner image is then fixed with heat and pressure by the fixing apparatus 25. The transfer medium is then ejected onto an ejection tray 57 by an ejection roller 56 while directing a switching pick in a prescribed direction, thereby being stacked on an ejection tray 57. Otherwise, the transfer medium enters into a transfer medium inversion apparatus 28 when the switching pick 55 is directed to the other direction. The transfer medium is then inverted and guided to the transfer position again. The transfer medium then receives an image on its backside, and is finally ejected onto the ejection roller 57 by the ejection roller 56.

An intermediate transfer member cleaning apparatus 17 removes toner remaining on the intermediate transfer member 10 after image transfer to prepare for the next image formation by the tandem type image formation apparatus 20.

Figure 3:
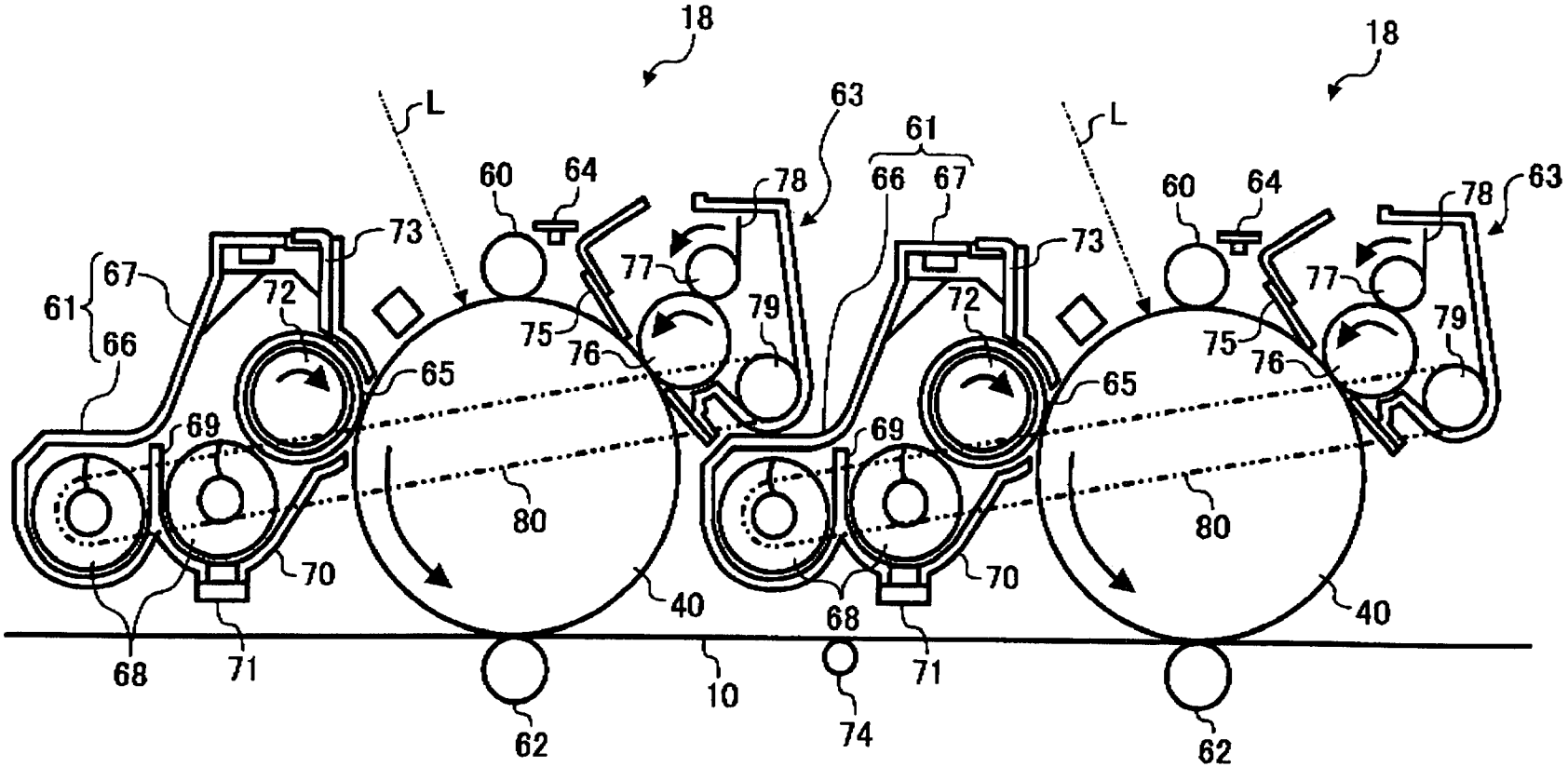
FIG. 3 illustrates an exemplary periphery of stations of the color copier.

As shown in FIG. 3, in each of the respective image formation units 18 of the respective stations of the above-mentioned tandem image formation apparatus 20, a charging apparatus 60, a developing apparatus 61, a primary transfer apparatus 62, an image bearing member cleaning apparatus 63, and a charge removing apparatus 64 or the like are arranged around the drum shape image bearing member 40. The image bearing member 40 is produced by coating a drum shaped aluminum tube with organic photosensitive material having photosensitive property. The image-bearing member, however, can be an endless belt type.

Although not shown in the drawings, one of the charging apparatus 60, the developing apparatus 61, and the image-bearing member cleaning apparatus 63 is integrated with the image-bearing member 40 to form the process cartridge. The process cartridge is preferably detached from the image forming apparatus body 100 at each of the stations so as to improve a maintenance performance and downsizing.

The charging apparatus 60 has a roller shape, and contacts and charges the image-bearing member 40 with a voltage.

Beside one component dry type developer, the developing apparatus 61 preferably uses two-component dry type developer including magnetic carrier and non-magnetic toner. The developing apparatus 61 includes a stirring section 66 that stirs and conveys the two-component developer toward the developing sleeve 65 so that the two-component developer is attracted thereto. Also included is a developing section 67 that transfers toner among the two-component developer from the developing sleeve 65 to the image bearing member 40. The stirring section 66 is located below the developing section 67.

Figure 6:
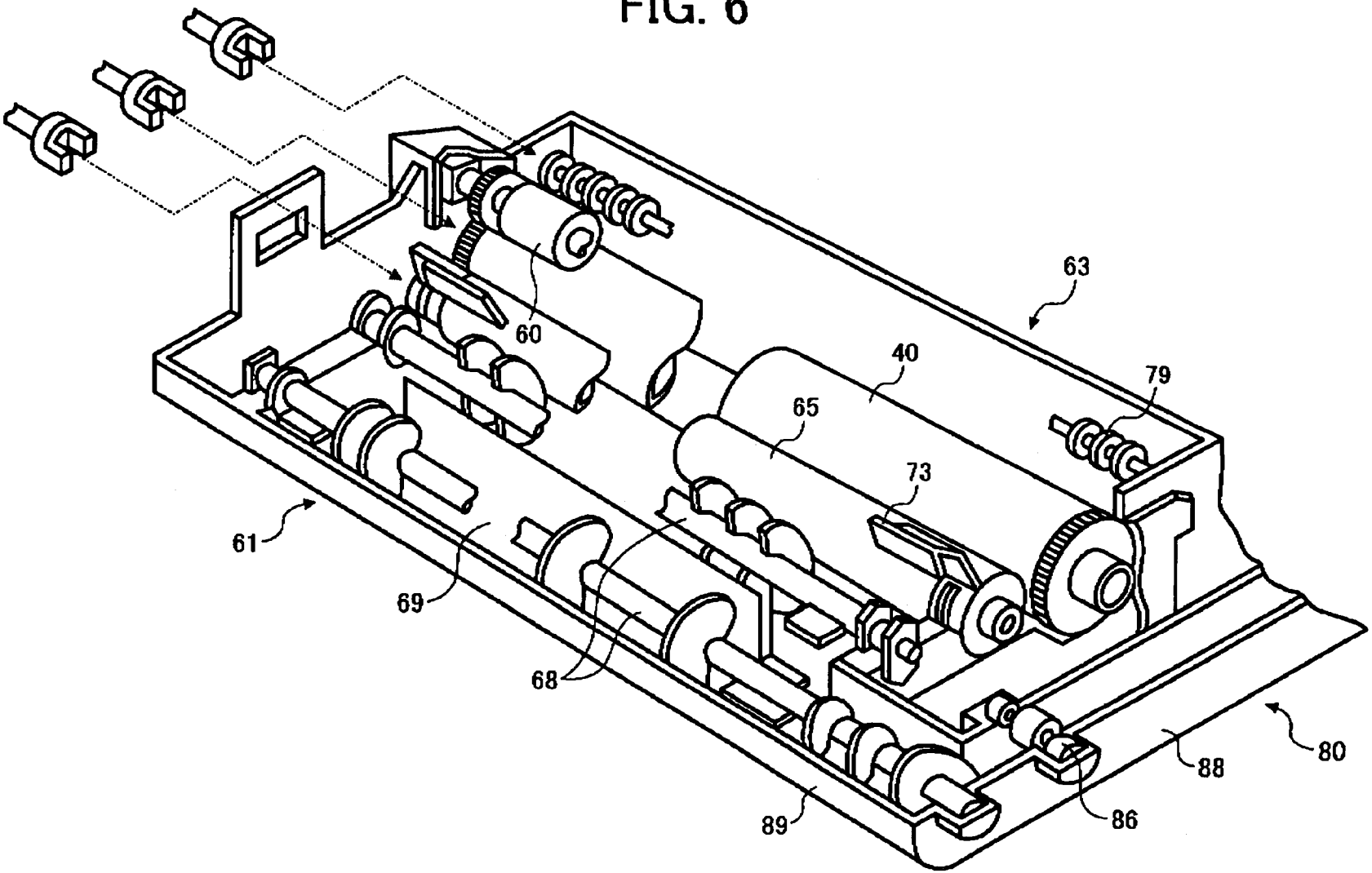
FIG. 6 illustrates the toner recycle apparatus arranged on the side of the developing apparatus.

The stirring section 66 includes a pair of parallel screws 68. A partition 69 is provided to divide off the pair of screws 68 except for both side ends as illustrated in FIG. 6. A toner density sensor 71 is attached to a developing casing 70.

A developing sleeve 65 is opposed to the image-bearing member 40 through an opening of the developing casing 70 in the developing section 67. A magnet 72 is secured to an inside of the developing sleeve 65. A doctor blade 73 is arranged with its tip being approximated to the developing sleeve 65. A gap of the nearest sections between the doctor blade 73 and the developing sleeve 65 has a distance of 500 micrometer, for example.

Further, the two-component developer is conveyed to the developing sleeve 65 by being stirred and circulated by the pair of screws 68. The developer supplied to the developing sleeve 65 is scooped up and held by the magnet 72, and thereby a magnet brush is formed on the developing sleeve 65. An ear of the magnet brush is then chopped by the doctor blade 73 as the developing sleeve 65 rotates so that a prescribed thickness of the magnet brush remains. Thus cut off developer is returned to the stirring section 66.

Toner among the developer on the developing sleeve 65 spreads to the image bearing member 40 due to the developing bias applied to the developing sleeve 65, thereby visualizing a latent image on the image bearing member 40. Developer remaining on the developing sleeve 65 then departs from the developing sleeve 65 at a section free from magnetic force of the magnet 72 and returns to the stirring section 66. By repeating the above-mentioned operation and detecting density of the toner stored in the stirring section 66 using the toner density sensor 71, fresh toner is supplied to the stirring section 66 when the toner density sensor 71 detects and recognizes that the toner becomes thin.

In this example, a line speed of the image-bearing member 40 is about 200 mm/s, and that of the developing sleeve 65 is about 240 mm/s. A diameter of the image-bearing member 40 is about 50 mm while that of the developing sleeve 65 is about 18 mm. An amount of charge carried by toner of a developing sleeve 65 ranges from about −10 to about −30 μC/g. A developing gap Gp formed between the image-bearing member 40 and the developing sleeve 65 is preferably from about 0.8 mm to about 0.4 mm. When reducing such a value, developing efficiency can be improved.

For example, a thickness of the image bearing member 40 is about 30 μm, a diameter of a beam spot of an optical system is 50×60 μm, and an amount of light is about 0.47 nW. Development is executed on conditions that a charge potential Vo (before exposure) on the image bearing member 40 is about −700V, a post exposure potential VL is about −120V, and a developing bias is about −470V. Specifically, a developing potential is about 350V.

When developing in the developing apparatus 61, an electric field is preferably changed. Specifically, as shown in FIG. 3, a direct current is applied by a power source (not shown) to provide developing bias to the developing sleeve 65.

The primary transfer apparatus 62 has a roller shape and pressure contacts the image-bearing member 40 via the intermediate transfer member 10. However, it is not limited to the roller shape, and can be a non-contact type corona charger and similar devices.

The image-bearing member cleaning apparatus 63 includes a cleaning blade 75 with its tip pressure contacting the image-bearing member 40. The cleaning blade 75 is made of polyurethane and includes a fur brush 76 having electrical conductivity. The fur brush contacts the image-bearing member 40 and is freely rotated in a direction shown by an arrow. Further, a metal electric field roller 77 is freely rotatably arranged to apply bias to the fur brush 76. A tip of a scraper 78 pressure contacts the metal electric field roller 77. A collection screw 79 is arranged to collect toner removed.

The fur brush 76 removes toner remaining on the image-bearing member 40 while rotating in a direction to counter the image-bearing member 40. The metal electric field roller 77 removes toner attracted to the fur brush while rotating in a direction to counter the fur brush 76. The scraper 78 cleans the metal electric field roller 77. The toner collected by the image-bearing member cleaning apparatus 63 is shifted to one side of the image-bearing member cleaning apparatus 63 by the collection screw 79. Thus, the toner is returned to the developing apparatus 61 by the later described toner recycle apparatus 80 to be reused.

The charge removing apparatus 64 includes a lamp, and initializes a surface potential of the image-bearing member 40 by emitting light.

As the image bearing member 40 rotates, the charging apparatus 60 uniformly charges the surface of the image bearing member 40. The above-mentioned exposure apparatus 21 then emits writing light L of a laser or an LED in accordance with reading results of the scanner 300. Thereby, a latent image is formed on the image bearing member 40.

Then, the developing apparatus 61 develops the latent image with the toner. The primary transfer apparatus 62 transfers such a visualized image onto the intermediate transfer member 10.

The image-bearing member cleaning apparatus 63 removes the toner remaining on the image-bearing member 40 after the image transfer thereby cleaning the surface thereof. The charge removing apparatus 64 removes charge to prepare for the next image formation.

Figure 4:
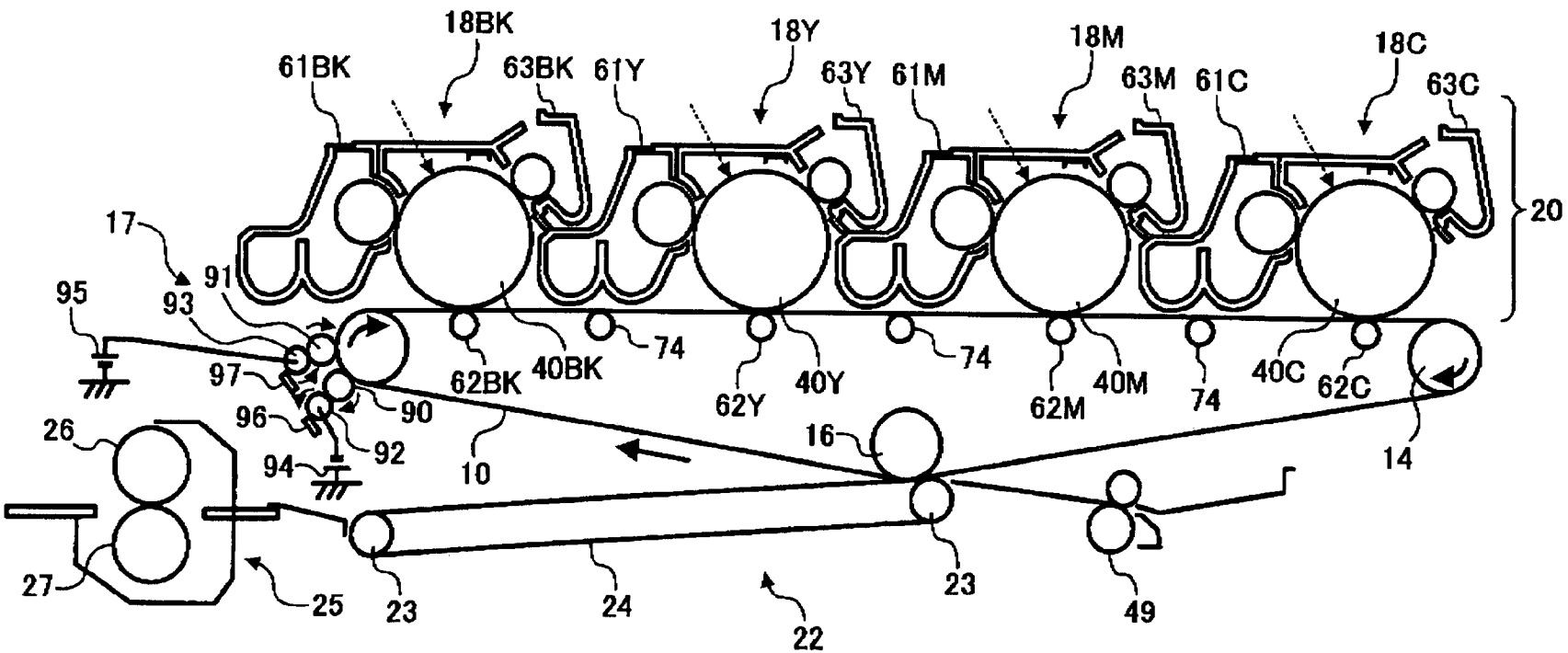
FIG. 4 illustrates an exemplary periphery of a tandem type image forming apparatus.

Details of the color copier of FIG. 1 are shown in FIG. 4 as mentioned earlier.

Figure 5:
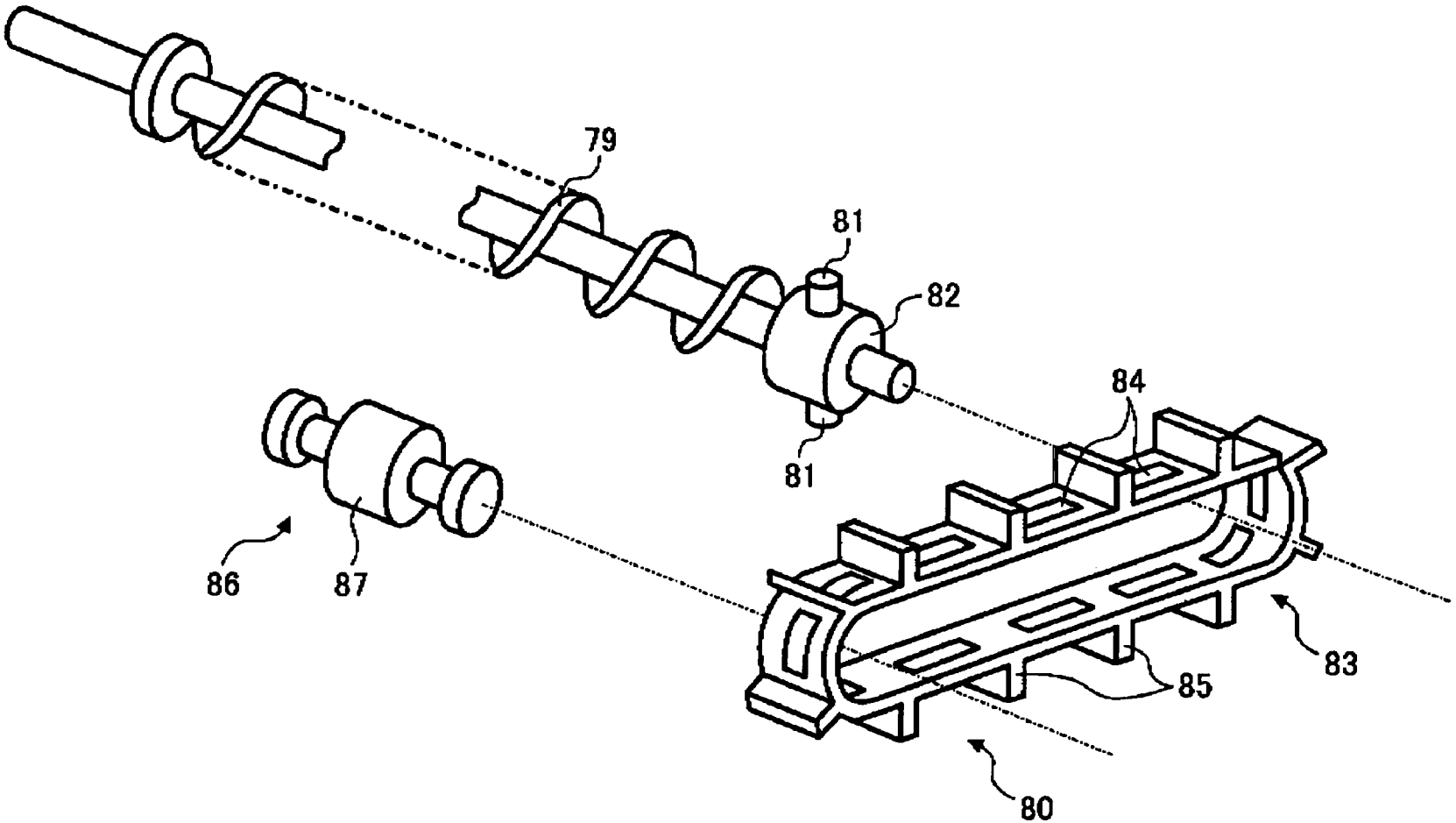
FIG. 5 illustrates an exemplary toner recycle apparatus arranged on the side of the image forming apparatus.

The toner recycling apparatus 80 is now described in more detail with reference to FIGS. 5 and 6. As shown in FIG. 5, the collection screw 79 includes a roller section 82 having a pin 81 at its one end. One side of a belt shape toner conveyance member 83 is supported by the roller section 82, while the pin 81 is inserted into a long hole 84 formed on the toner conveyance member 83. A plurality of shuttlecocks 85 are arranged at a prescribed interval on the periphery of the toner conveyance member 83 while the other side hangs on the roller section 87 of the rotary shaft 86.

The toner conveyance member 83 is housed in a conveyance path casing 88 together with the rotary shaft 86 as illustrated in FIG. 6. The conveyance path casing 88 is integrally manufactured with the cartridge casing 89 and houses one of the above-mentioned pair of screws 68 arranged on the side of the developing apparatus 61.

When the collection screw 79 and the toner conveyance member 83 are rotated by an externally transmitting driving force, toner collected by the image bearing member cleaning apparatus 63 is conveyed to the developing apparatus 61 through the conveyance path casing 88. The toner then enters into the developing apparatus 61 as screws 68 rotate. Then, as mentioned earlier, the pair of screws 68 stir and circularly convey the toner mixed with other toner stored in the developing apparatus 61, and supplies such to the developing sleeve 65. The ear of the toner is then cut by the doctor blade 73 and the toner spreads to the image bearing member 40, thereby developing a latent image on the image bearing member 40.

The developing sleeve 65 is a non-magnetic type and is rotatable. The developing sleeve 65 houses a plurality of magnets. Since the magnet is secured, magnetic force is effective when developer passes through a prescribed position. For example, a diameter of the developing sleeve 65 is 18 mm. The surface of the developing sleeve 65 is roughened to have a ten-point mean roughness RZ of from 10 to 30 μm by sandblasting or a plurality of grooves each having a depth of from 1 to a few millimeters.

The magnet 72 includes magnetic poles of for example N1, S1, N2, S2, and S3 in a rotational direction of the developing sleeve 65 starting from a section of the doctor blade 73. Toner and magnetic particle picked up by the magnet 72 are carried by the developing sleeve 65 as developer. The toner is charged when mixed with the magnetic particle. For example, an amount of from about −10 to about −30 μC/g is preferably charged. The developing sleeve 65 is opposed to the image bearing member 40 on the S1 side of the magnet 72 that forms magnetic brush of the developer.

EXAMPLES

Now, exemplary magnet carrier and toner are described.

Preparation of Magnetic Carrier:

Silicone resin and Nylon resin mixed solution A: 100 parts

Carbon black: 4 parts

Toluene: 100 parts

The mixture thus obtained was stirred and further mixed by a HOMOMIXER for 30 minutes, and thereby a coat layer forming liquid was produced. The coat layer forming liquid was coated on the surface of a ferrite 1000 parts having a volume average particle diameter of about 35 μm using a fluidized bed type coating apparatus. Thus, a coat layer was formed, and thereby magnetic carrier A was produced. It was confirmed from an experiment that when the magnetic carrier A and reference toner (e.g. Ricoh Imagio color toner type S, black) were mixed by a weight ratio of 100/7 (i.e., carrier/toner) and were stirred by a roll mill for about 10 minutes, the toner had a charge of about 23.4 μc/g.

Magnetic carrier B was produced using silicone resin and nylon resin mixture liquid B in place of the above-mentioned silicone resin and nylon resin mixture liquid A of the magnet carrier A. It was confirmed from an experiment that when the magnetic carrier A and the reference toner were mixed by a weight ratio of 100/7 (i.e., carrier/toner) and were stirred by the roll mill for about 10 minutes, the toner had a charged of about 25.6 μC/g.

Magnetic carrier C was produced using silicone resin and nylon resin mixture liquid C in place of the above-mentioned silicone resin and nylon resin mixture liquid A of the magnetic carrier A. It was confirmed from an experiment that when the magnetic carrier A and the reference toner were mixed at a weight ratio of 100/7 (i.e., carrier/toner) and were stirred by the roll mill for about 10 minutes, the toner charge amount was about 28.4 μC/g.

Magnetic carrier D was produced using silicone resin and nylon resin mixture liquid D in place of the above-mentioned silicone resin and nylon resin mixture liquid A of the magnetic carrier A. It was confirmed from an experiment that when the magnetic carrier A and the reference toner were mixed by a weight ratio of 100/7 (i.e., carrier/toner) and were stirred by the roll mill for about 10 minutes, the toner charge amount was about 30.1 μC/g.

Preparation of Toner:

Polyester resin B (softening point 110° C., Tg66° C.): 100 parts

Carnauba wax: 5 parts

Copper phthalocyanine blue pigment: 4 parts

Zinc-containing salicylate compound: 2.5 parts

The above-mentioned raw materials were mixed by a HENSCHEL MIXER (manufactured by Mitsui-Miike Machinery Co., Ltd.), and the mixture was melted, kneaded, and cooled by a KO-KNEADER from Buss AG (manufactured by Buss AG) at a temperature of 130° C. Then, the cooled material was finely crushed by a crusher that employs TURBO MILL (manufactured by Turbo Kogyo Co., Ltd.) followed by classification with a pneumatic separator. As a result, a cyan mother toner A having a volume average particle diameter of about 6.5 μm was obtained.

With the above-mentioned mother toner, TG-810G (a silica manufactured by CABOT Corp., BET specific surface area: 230 $m^2/g$) and MT150AMF (a titania manufactured by Tayca Corp., BET specific surface area: 65 $m^2/g$) were mixed by the HENSCHEL MIXER by a ratio of 1 versus 1 (silica versus titan) so that the covering rate of the mother toner becomes 75%. As a result, an electrophotographic cyan toner A was obtained.

Electrophotographic cyan toner B was obtained in the same manner as the cyan toner A except for changing weight parts of zinc containing salicylate of the cyan toner A to 1.5.

Instead of the above-mentioned copper phthalocyanine blue pigment of the cyan toner mother body A, a quinacridone magenta pigment was used by 8 parts. A kneaded material was obtained and cooled. The kneaded mixture was then finely crushed by the crusher of the TURBO MILL followed by classification with a pneumatic separator. As a result, a magenta mother toner A having a volume average particle diameter of about 6.5 μm was obtained.

With the toner mother body A, the TG-810G and the MT150AMF are mixed by the HENSCHEL MIXER by a ratio of 1 versus 1 (silica versus titania) so that the covering rate of the mother toner becomes 75%. As a result, an electrophotographic magenta toner A was obtained.

An electrophotographic magenta toner B was obtained in the same manner as the magenta toner A except for changing the added amount of the zinc containing salicylate compound of the magenta toner A to 3.5.

Further, pigment yellow was used by 7 parts in place of the copper phthalocyanine blue pigment of the above-mentioned cyan toner mother body A. They were kneaded, cooled down, crushed by the crusher of TURBO MILL, and classified by a pneumatic separator in the similar manner as mentioned above. As a result, a yellow mother toner A having a volume average particle diameter of about 6.5 μm was obtained.

With the mother toner A, the TG-810G and the MT150AMF were mixed by the HENSCHEL MIXER by a ratio of 1 versus 1 (between silica and oxide titan) so that the covering rate of the mother toner becomes 75%. As a result, an electrophotographic yellow toner A was obtained.

Further, carbon black was used by 6.4 parts in place of the copper phthalocyanine blue pigment of the above-mentioned cyan mother toner A. They were then kneaded, cooled, crushed by the crusher of the TURBO MILL, and classified by a pneumatic separator in the similar manner as mentioned above. As a result, a black mother toner A having a volume average particle diameter of about 6.5 μm was obtained.

With the mother toner A, the TG-810G and the MT150AMF were mixed by the HENSCHEL MIXER by a ratio of 1 versus 1 (between silica and oxide titan) so that the covering rate of the mother toner becomes 100%. As a result, an electrophotographic black toner A was obtained (Coating rate=Total projected area of external additive/Total surface area of mother toner).

In FIG. 7, a Table 1 illustrates a relation between a charge of toner and an adhering rate of an external additive obtained in a manner such that the aforementioned toner and reference carrier (manufactured by Powdertech Co., Ltd. FPC-300LC_CA18) were mixed by a weight ratio of 100/7 (carrier/toner) and were stirred by the roll mill for about 10 minutes.

By comparing the charge abilities of the toners, the below-described relation was found:

Black toner A>Magenta toner B>Cyan toner A>Yellow toner A>Magenta toner A>Cyan toner B Further, color mixture was evaluated in the below described manner using combined developer shown in the Table 2 of FIG. 8.

Specifically, after continuous copying of 50,000 sheets, a solid image was formed on a transfer sheet (Type 6000 (70W), manufactured by Ricoh Co., Ltd.) with its adhering amount being 1.00±0.05 mg/cm$^2$ under the below-described fixing condition.

Then, (a*),(b*), and (L*) of the solid image of the second and third colors were measured by the X-Rite938. Then, a color difference from the original color was determined using the below described formula. The resultants thereof are shown in the Table 3 of FIG. 9, wherein a symbol "○" represents that ⊿E*ab is "Less than 1", a symbol "Δ" represents that ⊿E*ab is "not less than 1 and less than 2", and a symbol "x" represents that ⊿E*ab is "Not less than 2".

$$\Delta E^*ab=((\Delta L^*)\Lambda 2+((\Delta a^*)\Lambda 2+((\Delta b^*)\Lambda 2)\Lambda(1/2)$$

The fixing conditions were as follows:

Line speed of fixing machine: 180±2 mm/sec

Width of fixing nip: 10±1 mm

Temperature of fixing roller: 160±2° C.

Further, a result of evaluation with visual judgment as to whether toner scattering occurring in a copier after color mixture evaluation was completed is also shown in the Table 3.

Numerous additional modifications and variations of the present invention are possible in light of the above teachings. It is therefore to be understood that within the scope of the appended claims, the present invention may be practiced otherwise that as specifically described herein.

The invention claimed is:

1. A multi-color image forming apparatus, comprising:

at least two stations each configured to form a unique mono color toner image using mono-color developer including prescribed mono-color toner, each of said at least two stations including an image bearing member configured to bear a latent image, and a developing device configured to visualize the latent image into the mono-color toner image, each of said at least two stations being arranged side by side;

a conveying device configured to convey a transfer medium; and a transfer device configured to transfer each of the mono color toner images from each of the respective image bearing members to the transfer medium;

wherein charge ability of said prescribed mono-color toner included in the mono-color developer used in an upstream of the at least two stations is smaller than that used in a downstream of the at least two stations.

2. The multi-color image forming apparatus as claimed in claim 1, wherein charge applying ability of the upstream station is larger than that of the downstream station.

3. The multi-color image forming apparatus as claimed in claim 1, wherein a direct current developing bias is applied to the developing device when each of the at least two stations visualizes the latent image.

4. The multi-color image forming apparatus as claimed in claim 1, wherein adherence other than electrostatic adherence of said toner to the image bearing member is less than that to the transfer medium.

5. The multi-color image forming apparatus as claimed in claim 1, wherein said toner includes an external additive and mother toner particle.

6. The multi-color image forming apparatus as claimed in claim 5, wherein said external additive includes at least two different inorganic particles.

7. The multi-color image forming apparatus as claimed in claim 5, wherein said external additive has a toner adhering rate not less than 70%.

8. The multi-color image forming apparatus as claimed in claim 1, wherein each of said at lest two stations further comprises a collecting device configured to collect the toner remaining on the image bearing member after transfer of the toner image onto the transfer medium, said collecting device conveying the toner to the developing device.

9. The multi color image forming apparatus as claimed in claim 1, wherein each of said at least two stations further includes:

a charging device configured to charge the image bearing member; and a cleaning device configured to remove the toner remaining on the image bearing member after the transfer of the toner;

wherein one of the charging device, the developing device, and the cleaning device is integrated with the image bearing member as a process cartridge, wherein said process cartridge is detached from the multi-color image forming apparatus.

10. A multi-color image forming apparatus, comprising:

at least two means for forming a unique mono-color toner image using mono-color developer including prescribed mono-color toner, each of said at least two means for forming including an image bearing member configured to bear a latent image, and a developing device configured to visualize the latent image into the mono-color toner image, each of said at least two means for forming being arranged side by side;

means for conveying a transfer medium; and means for transferring each of the mono-color toner images from each of the respective image bearing members to the transfer medium;

wherein charge ability of said prescribed mono-color toner included in the mono-color developer used in an upstream of the at least two means for forming is smaller than that used in a downstream of the at least two means for forming.

11. The multi-color image forming apparatus as claimed in claim 10, wherein charge applying ability of the upstream means for forming is larger than that of the downstream means for forming.

12. The multi-color image forming apparatus as claimed in claim 10, wherein a direct current developing bias is applied to the developing device when each of the at least two means for forming visualizes the latent image.

13. The multi-color image forming apparatus as claimed in claim 10, wherein adherence other than electrostatic adherence of said toner to the image bearing member is less than that to the transfer medium.

14. The multi-color image forming apparatus as claimed in claim 10, wherein said toner includes an external additive and mother toner particle.

15. The multi-color image forming apparatus as claimed in claim 14, wherein said external additive includes at least two different inorganic particles.

16. The multi-color image forming apparatus as claimed in claim 14, wherein said external additive has a toner adhering rate not less than 70%.

17. The multi-color image forming apparatus as claimed in claim 10, wherein each of said at least two means for forming further comprises a collecting device configured to collect the toner remaining on the image bearing member after transfer of the toner image onto the transfer medium, said collecting device conveying the toner to the developing device.

18. The multi color image forming apparatus as claimed in claim 10, wherein each of said at least two means for forming further includes:

a charging device configured to charge the image bearing member; and a cleaning device configured to remove the toner remaining on the image bearing member after the transfer of the toner;

wherein one of the charging device, the developing device, and the cleaning device is integrated with the image bearing member as a process cartridge, wherein said process cartridge is detached from the multi-color image forming apparatus.

* * * * *